US011484185B2

(12) United States Patent
Xie

(10) Patent No.: US 11,484,185 B2
(45) Date of Patent: Nov. 1, 2022

(54) DISPOSABLE DUSTING CLOTH AND METHOD OF MANUFACTURE

(71) Applicant: Americo Manufacturing Co., LLC, Acworth, GA (US)

(72) Inventor: Tonny Xie, Shanghai (CN)

(73) Assignee: Americo Manufacturing Co., LLC, Acworth, GA (US)

( * ) Notice: Subject to any disclaimer, the term of this patent is extended or adjusted under 35 U.S.C. 154(b) by 13 days.

(21) Appl. No.: 16/283,168

(22) Filed: Feb. 22, 2019

(65) Prior Publication Data

US 2019/0254500 A1 Aug. 22, 2019

Related U.S. Application Data

(60) Provisional application No. 62/634,024, filed on Feb. 22, 2018.

(51) Int. Cl.

| | |
|---|---|
| ***A47L 25/00*** | (2006.01) |
| ***A47L 13/16*** | (2006.01) |
| *A47L 13/20* | (2006.01) |

(52) U.S. Cl.

CPC ..... *A47L 25/005* (2013.01); *A47L 13/16* (2013.01); *A47L 13/20* (2013.01)

(58) Field of Classification Search

CPC ..... A47L 25/005; A47L 13/16; A47L 13/20

See application file for complete search history.

(56) References Cited

U.S. PATENT DOCUMENTS

| | | | | |
|---|---|---|---|---|
| 3,192,679 | A * | 7/1965 | Cameron | A47L 13/07 401/195 |
| 4,437,271 | A * | 3/1984 | McAvoy | A47L 13/16 451/532 |
| 6,314,627 | B1 * | 11/2001 | Ngai | B32B 5/26 28/104 |
| 6,746,974 | B1 * | 6/2004 | Reiterer | A47L 13/51 15/104.93 |
| 7,560,398 | B2 | 7/2009 | Zillig et al. | |
| 2017/0022660 | A1 * | 1/2017 | Suer | D06N 7/00 |
| 2019/0117035 | A1 * | 4/2019 | Schmitz | D04H 13/00 |

* cited by examiner

*Primary Examiner* — Shay Karls

(74) *Attorney, Agent, or Firm* — Nelson Mullins Riley & Scarborough LLP

(57) ABSTRACT

A disposable cleaning wipe that can used by hand or by attachment to a sweeper is provided wherein the cleaning wipe has tacky pick-up material concentrated at its working surfaces as opposed to within its intermediate region.

14 Claims, 1 Drawing Sheet

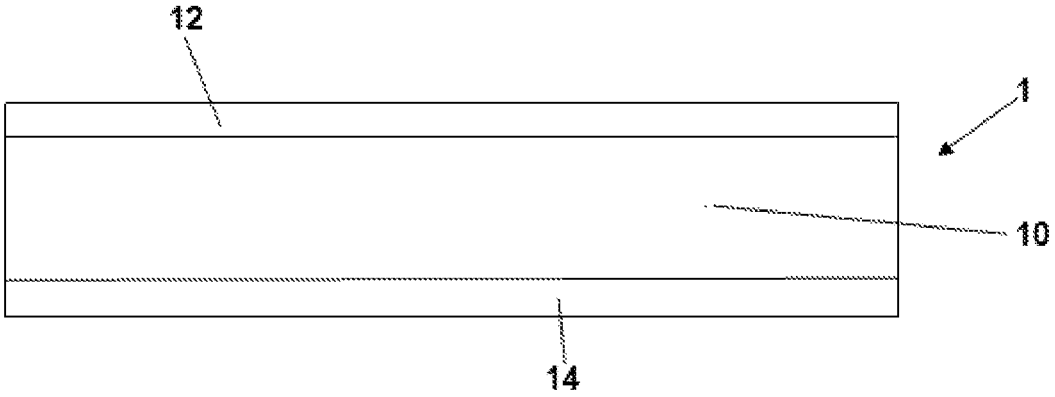
12
1
10
14

DISPOSABLE DUSTING CLOTH AND METHOD OF MANUFACTURE

CLAIM OF PRIORITY

This application claims the benefit of U.S. Provisional Application Ser. No. 62/634,024, filed Feb. 22, 2018. The entire contents of the above-referenced application is incorporated herein by this reference.

FIELD OF THE INVENTION

The present invention relates to disposable dusting cloths and wipes and methods of manufacture.

BACKGROUND OF THE INVENTION

Cleaning cloths are common products used primarily for wiping dust from the surface of objects. Cloths and other wiping products have been known for a very long time, and remarkable improvements in those products have been infrequent. Most wiping products, or wipes, are made from either a woven or nonwoven sheet, and are used either by hand or on the end of a mop handle to move dirt and dust in a desired direction. When the dirt or dust has been collected, the wipe may be scrunched up by the user to try to capture the dirt or sand that has been collected so that it can be shaken out in the trash. Other wipes are designed to wipe up the dirt or dust and be disposed of along with the dirt or dust.

For example, residential or household consumers commonly use cleaning wipes or cloths to remove debris from various surfaces around the home. A so-called "dust cloth" or "dust sheet" is an exemplary item used for these applications. These and similar cloth materials are quite useful for removing dust and other minute particles from surfaces.

Sweeper mops have a head to which the dusting cloth may be attached. The sweeper mop head typically has an attached handle to allow the user to navigate the mop head with attached dusting cloth to surfaces that need to be wiped or dusted.

Market-existing cleaning cloths are usually made up of traditional materials, typically having poor dust adhesion when the wipe is dry. Thus, users often soak traditional cleaning cloths in water or other liquids to increase the pick-up of the cloth. However, even wetted wipes are often not efficient for cleaning and picking up certain items, such as hair, from surfaces that are being wiped.

When used on sweeper mops, it is often undesirable to wet the wipe for various reasons, including the propensity for leaving a wet surface after wiping. This is particularly true if a liquid other than water is used to wet the wipe.

Additives have been added to wipes in the past, including waxes, pest control ingredients, microbials, and other ingredients. Typically, in most such additive-containing wipes, the additive is dispersed generally uniformly throughout the wipe and throughout its thickness. Thus, such known additive-containing wipes will generally have the same amount of additive on its opposed surfaces as well as throughout the center portion of the wipe.

Of course, removing debris from surfaces is not limited to household cleaning applications. Many industrial applications entail the use of a cleaning wipe. For example, the vehicle painting/repainting industry and wood finishing industry commonly make use of "tack cloths" to remove debris from surfaces that are to be painted or stained. Generally, tack wipes or tack cloths comprise some form of textile material that has an open structure and is treated with a pressure sensitive adhesive or some other tacky polymer or material to give the tack cloth a sticky or tacky characteristic. When such a wipe is rubbed over a surface, foreign matter which is present on the surface will adhere to the wipe and be removed.

At least one engineered wipe has been disclosed which regulates the amount of additive between its outside surfaces and the center portion of the wipe. In particular, U.S. Pat. No. 7,560,398 describes a cleaning wipe that contains a tacky material as an additive. Instead of being dispersed generally uniformly throughout the wipe, the tacky material is concentrated within the intermediate, or center, portion of the wipe. In relative terms, more tacky material exists in the intermediate portion between the two opposing surface faces than exists at the opposing surfaces. The tacky material concentration is greater in the wipe's intermediate region than at its working surfaces.

Therefore, a need exists for an improved dry-use wipe, particularly for the attachment to sweeper mop heads, but which may also be used for hand dusting. In addition, a need exists for a wipe that has working surface tackiness that is greater than tackiness at non-working, intermediate regions of the wipe. The present invention addresses these and other needs.

SUMMARY OF THE INVENTION

One or more embodiments of the invention may address one or more of the aforementioned long-felt needs. For example, certain exemplary embodiments according to the present invention provide a wipe wherein a tacky material such as a pick-up adhesive, concentration is greater at at least one of the wipe's working surfaces than the concentration of the tacky material in the intermediate region. In other embodiments, the tacky material concentration at both working surfaces is greater than the tacky material concentration in the central portion of the wipe.

Various concentrations of the tacky material may be used in the intermediate portion and the working surfaces, provided the concentration of such tacky material is greater at one working surface than it is between the working surfaces.

Other embodiments of the present invention include the wipe of the present invention in combination with, and mounted on, a mop or sweeper head.

In addition, other embodiments of the present invention include the methods of manufacturing such wipes that have a greater concentration of tacky material at a working surface than between its working surfaces.

BRIEF DESCRIPTION OF THE DRAWINGS

The present invention now will be described more fully hereinafter with reference to the accompanying drawings, in which some, but not all embodiments of the invention are shown. The present invention may be embodied in many different forms and should not be construed as limited to the embodiments set forth herein; rather, these embodiments are provided so that this disclosure will satisfy applicable legal requirements and demonstrate exemplary embodiments of the invention. Repeat use of reference characters in the present specification and drawing is intended to represent same or analogous features or elements of the invention.

FIG. 1 illustrates a schematic side view of an embodiment of the present invention.

DETAILED DESCRIPTION OF PREFERRED EMBODIMENTS

Reference will now be made in detail to exemplary embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The present invention can be best understood by reference to the drawings, all of which show various embodiments of the presently inventive disposable wipe.

As shown in FIG. 1, the disposable wipe 1 is a single-layer material that can be divided generally into three sections: a first working surface 12, an intermediate section 10, and a second working surface 14. The lines in FIG. 1 dividing working surfaces 12 and 14 from intermediate region 10 are for illustration only and the exact division between a working surface and the intermediate region can vary depending on the particular embodiment of the present invention employed.

At least one of the working surfaces 12 and 14 will contain a tacky material. In addition, the other working surface as well as the intermediate region 10 may also contain a tacky material. However, the tacky material concentration will be greater at at least one of the working surfaces than within the intermediate region 10. In addition, in certain embodiments, the tacky material concentration may be greater at both working surfaces than within the intermediate region. For example, the tacky material concentration may be greater at working surface 12 than within intermediate region 10, the tacky material concentration may be greater at working surface 14 than within intermediate region 10, and the tacky material concentration may be greater at both working surfaces 12 and 14 than within intermediate region 10. Tacky material may be present in only one of the working surfaces, in both of the working surfaces, in one of the working surfaces and within the intermediate region, or in both of the working surfaces and within the intermediate region.

The purpose of the tacky material is to increase the pick-up ability of the wipe when it is used to collect dirt or dust. The tacky material acts to more readily adhere the dirt or dust to one, or both, of the working surfaces than dirt or dust would adhere to a working surface if no tacky material were present.

In one embodiment, the disposable dusting cloth is formed from a single layer clean cloth. The cloth is formed from polyester staple fiber having a fineness of 7 to 35 decitex ("dtex"). The cloth's weight may vary, but will typically be in the range of 100 grams per square meter ("gsm") to 110 gsm. However, weights outside of that range, both lower and higher, may be employed, depending on the particular end-use of the cloth.

The cloth from which the disposable dusting sheet is formed may be a non-woven or a woven fabric. The cloth may be a wadding. Typically, the cloth, whether it is woven or nonwoven, will be made from polyester fibers. In some embodiments, the cloth web may be formed from 100%. However, in some embodiments, other materials may be used and such woven and non-woven materials are well-known in the art. In addition the processes for making such non-woven and woven fabrics is well-known in the art. In addition, various colors may be used in the wipe as desired.

Typically, the tacky material is a pressure sensitive adhesive, such as a hot-melt pressure sensitive adhesive, a water-based pressure sensitive adhesive, or an oil-based pressure sensitive adhesive, may be used. However, any tacky material that can be loaded onto a working surface of the wipe and which will adhere dirt or dust sufficiently to be collected by the working surface may be utilized.

The amount of tacky material that should be applied depends on a number of factors, including the tackiness of the adhesive, the application process of the adhesive, the characteristics of the wipe, the degree to which the adhesive may adhere to surfaces (and thus makes wiping difficult), and other such factors. The amount of adhesive should be sufficient enough for the wipe to capture particles of various shapes and consistencies, such as lint, dust, and hair.

Typically, the tacky material will be sprayed onto both outer surfaces. However, pressure sensitive adhesive may be sprayed onto only one of the outer surfaces, depending on the particular characteristics desired.

The amount of tacky material added to a working surface may vary depending on the adhesion properties desired. In one embodiment, sufficient tacky material may be sprayed onto both working surfaces of the wipe to increase the basis weight of the material by 10 gsm or more. In other words, tacky material corresponding to an increase in basis weight of 5 gsm or more may be sprayed onto each of the separate working surfaces.

Wipes made according to the present invention are useful in cleaning dirt and dust from surfaces. During the cleaning process, one need only put some pressure on the dusting sheet and the added pressure sensitive adhesive will perform its adhering function to directly collect the dirt, dust, or other particles such as hair. The wipe quickly adheres the dirt, dust, or hair to the working surface of the wipe to which the tacky material has been added. The adherence of the dirt or dust to the working surface of the wipe is achieved without the necessity of water immersion as is required for certain known wiping cloths.

The particular manufacturing process may be varied, provided the tacky material is concentrated at one working surface more than it is within the intermediate region. One exemplary manufacturing process is as follows: A roll of web material (woven or non-woven) is pulled into a surface spraying machine. Web material passes a first spray nozzle through which a solid state pressure sensitive adhesive is sprayed at a temperature of approximately 160° C. temperature as a liquid onto the first side of the web under air pressure. When tacky material is to be applied to both working surfaces, the web proceeds to a second spray nozzle through which the same (or a different) tacky material is sprayed under similar conditions to the other working surface of the web.

After the tacky material is sprayed onto the web, the web is either allowed to dry or is forcefully dried (both allowing the web to dry and using a dryer are contemplated by the present invention). Next, the web is perforated and/or cut into the desired wipe size by a perforating/cutting machine. After cutting into the desired size, the individual wipes are then packaged and ready for use.

The wipes of the present invention may be used alone as a dusting cloth or in combination with a cleaning implement or tool such as a mop, a glove or mitt, a duster, or a roller and the like. When used with such cleaning implements or tools, the wipes may be sized to match the particular implement or tool. Sweeper mops are one particular tool which typically have a mounting head attached to a handle which a user may navigate along a floor or other surface such as a shelf to collect dirt and dust. Alternatively, the wipes can also be packaged in roll form or as a stack of sheets for easy dispensing.

These and other modifications and variations to the present invention may be practiced by those of ordinary skill in the art without departing from the spirit and scope of the present invention, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the invention as further described in such appended claims. Therefore, the spirit and scope of the appended claims should not be limited to the exemplary description of the versions contained herein.

What is claimed is:

1. A disposable cleaning wipe comprising:

(a) a single-layer fibrous material having a first working surface section and a second working surface section at opposing exterior sides of the single-layer fibrous material wherein each of the opposing working surface sections has an exposed surface and at least one of the opposing working surface sections comprises a tacky material designed to assist in picking up dirt and dust; and (b) an intermediate region between the two opposing working surface sections wherein the intermediate region comprises the tacky material;

wherein the concentration of tacky material at the at least one of the exposed surfaces is greater than the concentration of tacky material within the intermediate region.

2. The disposable cleaning wipe according to claim 1, wherein the exposed surface of the first working surface section and the exposed surface of the second working surface section comprise the tacky material and the concentration of tacky material at both exposed surfaces of the working surface sections is greater than the concentration of tacky material within the intermediate region.

3. The disposable cleaning wipe according to claim 2, wherein the concentration of tacky material at the exposed surfaces of the working surface sections is approximately the same.

4. The disposable cleaning wipe according to claim 1, wherein the wipe is shaped to conform to the surface of a sweeper mop head and to be attached thereto.

5. A sweeper mop comprising a handle and a sweeper mop head wherein the disposable cleaning wipe according to claim 1 is attached to the sweeper mop head.

6. The disposable cleaning wipe according to claim 1, wherein the wipe comprises polyester staple fiber having a fineness of 7 to 35 dtex.

7. The disposable cleaning wipe according to claim 1, wherein the wipe has a basis weight of 100 to 110 grams per square meter.

8. The disposable cleaning wipe according to claim 1, wherein the tacky material is a pressure sensitive adhesive.

9. The disposable cleaning wipe according to claim 8, wherein the pressure sensitive adhesive is chosen from the group consisting of a hot-melt pressure sensitive adhesive, a water-based pressure sensitive adhesive, and an oil-based pressure sensitive adhesive.

10. The disposable cleaning wipe according to claim 1, wherein the wipe comprises a polyester wadding.

11. The disposable cleaning wipe according to claim 1, wherein the wipe comprises a polyester non-woven web.

12. A method of manufacturing a disposable cleaning wipe comprising the steps of:

(a) forming a non-woven or woven single-layer fibrous material having a first working surface section and a second working surface section at opposing exterior sides of the single-layer fibrous material wherein each of the opposing working surface sections has an exposed surface and wherein the single-layer fibrous material has an intermediate region between the two opposing working surface sections;

(b) spraying a tacky material on at least one of the exposed surfaces of one of the working surface sections without compressing the non-woven or woven single-layer fibrous material so that the at least one of the working surface sections and the intermediate region comprises a tacky material and wherein the concentration of tacky material at the at least one of the exposed surfaces is greater than the concentration of tacky material within the intermediate region;

(c) drying the material to which the tacky material has been sprayed; and (d) cutting the material into multiple disposable cleaning wipes.

13. The method of manufacturing according to claim 12, wherein tacky material is sprayed onto both of the exposed surfaces of the working surface sections.

14. The method of manufacturing according to claim 12, wherein the material is cut into multiple disposable cleaning wipes prior to drying the material.

* * * * *